US007331505B2

(12) United States Patent
Holley, Jr.

(10) Patent No.: US 7,331,505 B2
(45) Date of Patent: Feb. 19, 2008

(54) CARTON FOR TAPERED ARTICLES

(75) Inventor: John M. Holley, Jr., Lawrenceville, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 0 days.

(21) Appl. No.: 11/287,844

(22) Filed: Nov. 28, 2005

(65) Prior Publication Data

US 2007/0119913 A1 May 31, 2007

(51) Int. Cl.
*B65D 5/06* (2006.01)
*B65D 65/12* (2006.01)

(52) U.S. Cl. ..... 229/103.2; 206/427; 229/136

(58) Field of Classification Search ..... 229/103.2, 229/116.1, 132, 136; 206/427; D9/430, D9/431, 432, 433
See application file for complete search history.

(56) References Cited

U.S. PATENT DOCUMENTS 755,221 A * 3/1904 Dynes ..... 229/103.2
2,067,998 A * 1/1937 Williamson ..... 229/116.1
3,078,989 A * 2/1963 Curran et al. ..... 229/116.1
3,815,735 A * 6/1974 Cucuo ..... 229/116.1
4,313,556 A * 2/1982 Boyle et al. ..... 229/116.1
5,020,668 A 6/1991 Schuster
6,129,266 A 10/2000 Oliff et al.
6,227,367 B1 * 5/2001 Harrelson et al. ..... 206/427
6,550,616 B2 * 4/2003 Le Bras ..... 206/427

FOREIGN PATENT DOCUMENTS

WO WO 02/30785 4/2002

* cited by examiner

*Primary Examiner*—Gary E Elkins

(57) ABSTRACT

A carton is provided with side walls that are shaped to securely or tightly enclose a group of tapered cylindrical articles. The curvature of the edges of each side wall is selected to cause the end wall or end closure structure to conform to the tapered shape of articles in the end most row that is disposed adjacent to the respective end closure structure of the carton. More specifically, the edges of each side wall are substantially continuously arcuate and the curvature of the edge is determined such that the maximum width of each side wall is greater than the width of the respective bottom edge of the side wall.

19 Claims, 3 Drawing Sheets

CARTON FOR TAPERED ARTICLES

TECHNICAL FIELD

This invention relates generally to cartons and, more specifically, to cartons that are shaped to better enclose a group of articles.

BACKGROUND OF THE INVENTION

Cartons are commonly used to enclose articles such as conventionally shaped bottles. To securely enclose a group of bottles, the side panels of a carton can be shaped to match the features of a bottle including a tapered neck and a cylindrical base with a relatively larger circular or other shaped cross-section. Accordingly, side panels have been gable-shaped with the lower edge portions of the side panel extending vertically from the bottom panel and the upper edge portions of the side panel extending at an angle from the respective lower edge portion to the top panel so as to follow the taper of the neck of the bottle.

Although, the gable-shaped carton is useful for enclosing a group of bottles, the bottom portion of each bottle is not supported as securely as the tapered portion. Therefore, a heretofore unaddressed need exists in the industry to provide a carton that is shaped to better stabilize the bottom portion of each bottle.

SUMMARY OF THE INVENTION

The various embodiments of the present invention overcome the shortcomings of the prior art by providing a carton with a curved side wall that has a tightening effect on a group of bottles to better stabilize the tapered and bottom portions of a bottle.

According to one aspect of the invention, a package includes a carton that encloses a group of articles, where each article is cylindrical with a cross-sectional area that may change in size and shape along the length of the article or otherwise taper, for example from a bottom portion having a maximum cross sectional area to an upper portion having a minimum cross sectional area that is less than the maximum cross sectional area. The carton includes an end closure structure and a pair of opposed side walls that are hingedly connected to opposite edges of the end closure structure, where each side wall includes a top edge, a bottom edge, and an end edge defined by the hinged connection between the side wall and the end closure structure. The end edge is substantially continuously arcuate so that the side wall has a width that varies along extent of the end edge. More specifically, the side wall has a maximum width that is greater than the extent of its bottom edge. The maximum width occurs at a distance from the bottom edge that is no greater than half the carton height, the carton height being defined as the distance between the top edge and the bottom edge.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
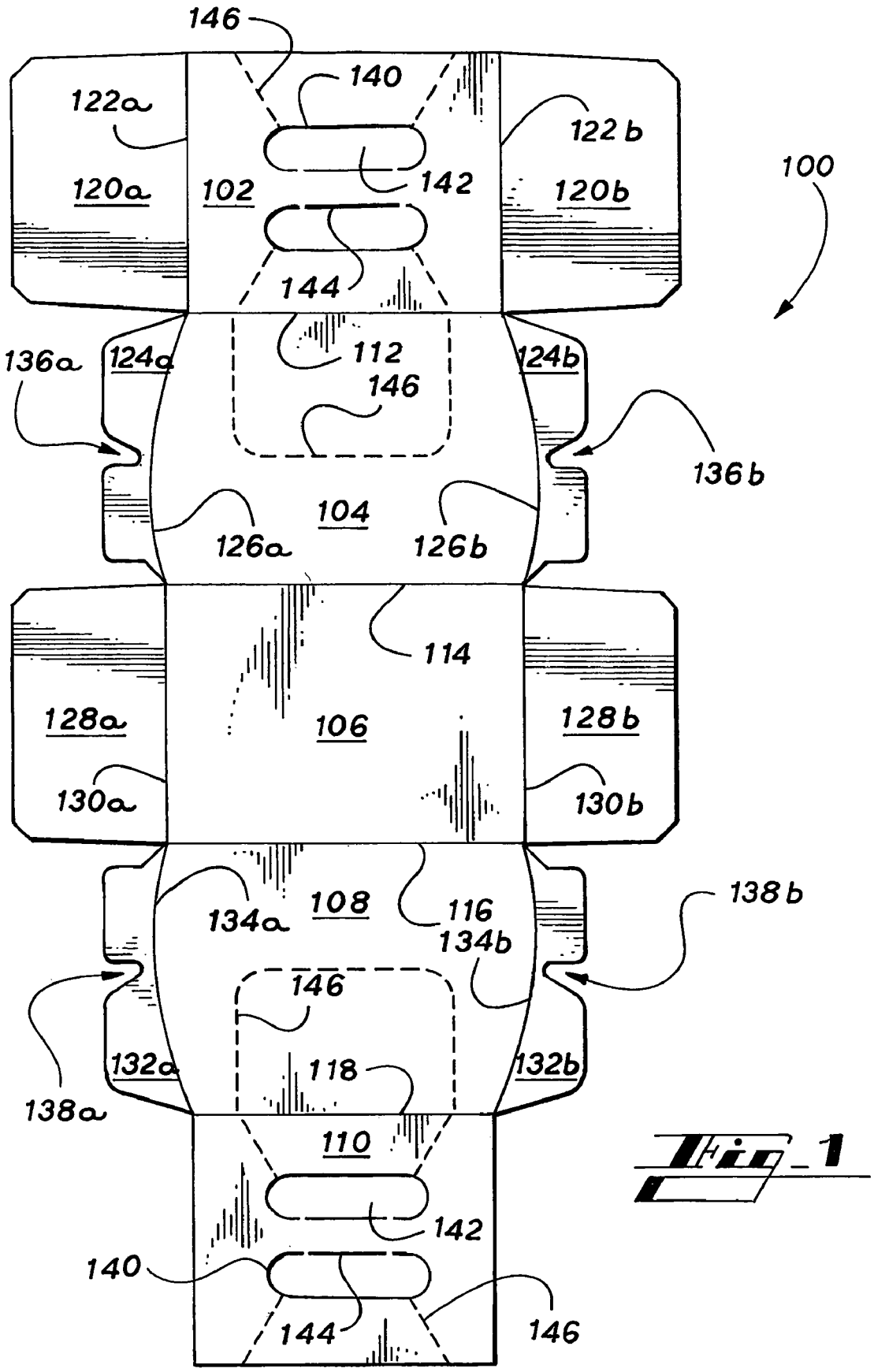
FIG. 1 is a plan view of an exemplary embodiment of a blank according to the present invention.

As required, detailed embodiments of the present invention are disclosed herein. It will be understood that the disclosed embodiments are merely examples to illustrate aspects of the invention that may be embodied in various and alternative forms. The figures are not necessarily to scale, and some features may be exaggerated or minimized to show details of particular components. In other instances, well-known materials or methods have not been described in detail to avoid obscuring the present invention. Therefore, specific structural and functional details disclosed herein are not to be interpreted as limiting, but as a basis for the claims and for teaching one skilled in the art to variously employ the present invention.

Referring now to the drawings in which like numerals indicate like elements throughout the several views, the drawings illustrate certain of the various aspects of an exemplary embodiment of a carton that is adapted for enclosing articles such as glass bottles according to the present invention. Generally speaking, the exemplary carton is formed from any foldable material, but preferably foldable sheet material such as paperboard, corrugated board, plastic, combinations or laminates of these materials, and the like. The carton includes side walls with substantially continuously arcuate or otherwise contoured edges that closely conform to the enclosed articles.

Figure 2:
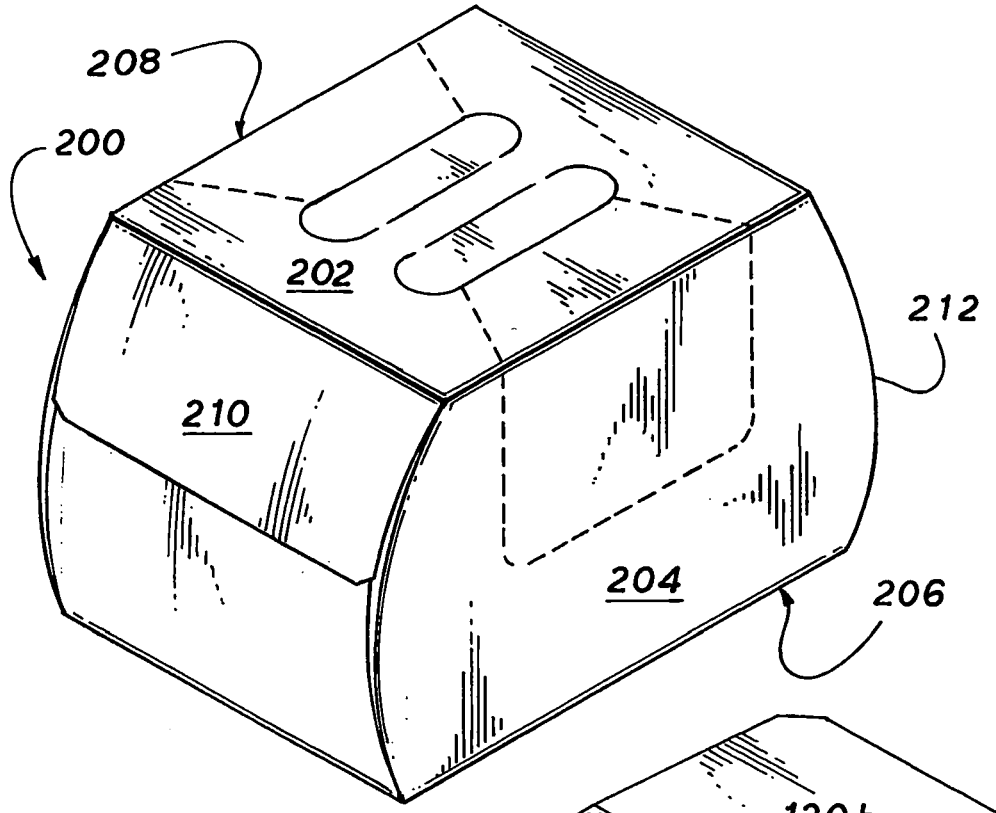
FIG. 2 is a perspective view of an exemplary embodiment of a carton formed from the blank of FIG. 1.

Referring now to FIG. 1, an exemplary embodiment of an elongated carton blank 100 according to the present invention may be folded and secured or otherwise assembled to form the carton 200 shown in FIG. 2. In FIG. 1, a unitary blank 100 is shown. Those skilled in the art will understand that two or more blanks may be used to form the illustrated blank 100. The blank 100 includes primary panels that are hingedly connected one to the next along a longitudinal axis. More specifically, the blank 100 includes an outer top panel 102, a first side panel 104, a bottom panel 106, a second side panel 108, and an inner top panel 110. The outer top panel 102 is hingedly connected to the first side panel 104 along fold line 112, which is substantially transverse to the longitudinal axis of the blank. Thus, fold line 112 defines the top edge of first side panel 104. The first side panel 104 is hingedly connected to the bottom panel 106 along transverse fold line 114, which defines the bottom edge of first side panel 104. The bottom panel 106 is hingedly connected to the second side panel 108 along transverse fold line 116, which defines the bottom edge of second side panel 108. The second side panel 108 is hingedly connected to the inner top panel 110 along transverse fold line 118, which defines the top edge of second side panel 108. It should be noted that, in an alternative embodiment, an edge flap may be substituted for the inner top panel 110. In the exemplary embodiment, the bottom panel 106 is substantially wider than the top panels 102, 110. Accordingly, the side panels 104, 108 have substantially continuously curving or arcuate end edges and varying width such that a longer bottom edge of each side panel 104, 108 is hingedly connected to the bottom panel 106 and a relatively shorter top edge of each side panel 104, 108 is hingedly connected to a respective top panel 102, 110.

Further, each of the panels 102, 104, 106, 108, is hingedly connected to opposing and preferably symmetric end flaps, defined in part by substantially longitudinally-oriented fold lines disposed along opposite end edges of the panels 102, 104, 106, 108. When erected, the end flaps cooperate to form a respective end closure structure 210, 212 (shown in FIG. 2). In the embodiments illustrated throughout, each set of end flaps is sufficiently identical that like references have been used, with "a" or "b" affixed to distinguish the components of one end of the carton from the other. In other words, with regard to the illustrated embodiments, typically what applies to the elements designated with an "a" reference applies equally to those elements designated with a "b" reference. Accordingly, for the sake of clarity, the present teaching and description will refer to only those elements with the "a" reference unless a clear understanding of the illustrated embodiments requires a discussion of an element with a "b" reference.

A top end flap 120*a* is hingedly connected to the outer top panel 102 along fold line 122*a*. A first side end flap 124*a* is hingedly connected along an end edge to the first side panel 104 along fold line 126*a*. A bottom end flap 128*a* is hingedly connected to the bottom panel 106 along fold line 130*a*. A second side end flap 132*a* is hingedly connected along an end edge to the second side panel 108 along fold line 134*a*. It should be noted that each fold line 126*a*, 134*a* forms a plane curve, i.e., fold line 126*a*, 134*a* is substantially continuous and arcuate so as to preferably include no intersecting linear segments, although the degree of curvature along the extent of the fold line 126*a* is not necessarily constant. Rather, it is contemplated that the degree of curvature at any given point P along each fold line 126*a*, 134*a* may be zero, but typically will have some magnitude as dictated by the contour of the intended articles.

The side end flaps 124*a*, 132*a* include a respective flap notch 136*a*, 138*a* that facilitates the folding of the side end flaps 124*a*, 132*a* along the arcuate fold lines 126*a*, 134*a*, and discourages bowing of the side panels 104, 108 during stacking, as will be described in more detail below.

The outer top panel 102 and the inner top panel 110 further include optional elements that define a handle and dispenser. More specifically, handle severance lines 140 at least partially define handle punchouts 142 that are hingedly connected to a respective top panel 102, 110 along a handle fold line 144. Here, the handle is illustrated as two elliptical shapes, believed to be comfortable to the user, but all known handles are contemplated and included in the scope of the invention. The blank 100 further includes severance lines 146 that extend from a respective handle severance line 140 and define a panel that may be at least partially torn away to gain access to enclosed articles. Each severance line 146 may be a tear line or any other weakened line that facilitates access to the interior of the carton 200. It is contemplated that each of the severance lines 146 includes, but is not limited to, a line of perforations, a line of short slits, a line of half cuts, a single half cut, pull tape, rip cords, and any combination of perforations, slits, score lines, half cuts, tape, cord, or the equivalent. As understood by those skilled in the art, the severance lines 146 assist the user with opening the carton and accessing the articles therein. As further understood by one skilled in the art, here the curvature, shape, and/or orientation of the severance lines 146 are merely design choices. Hence, the severance lines 146 are merely illustrative and are not limiting.

Figure 3:
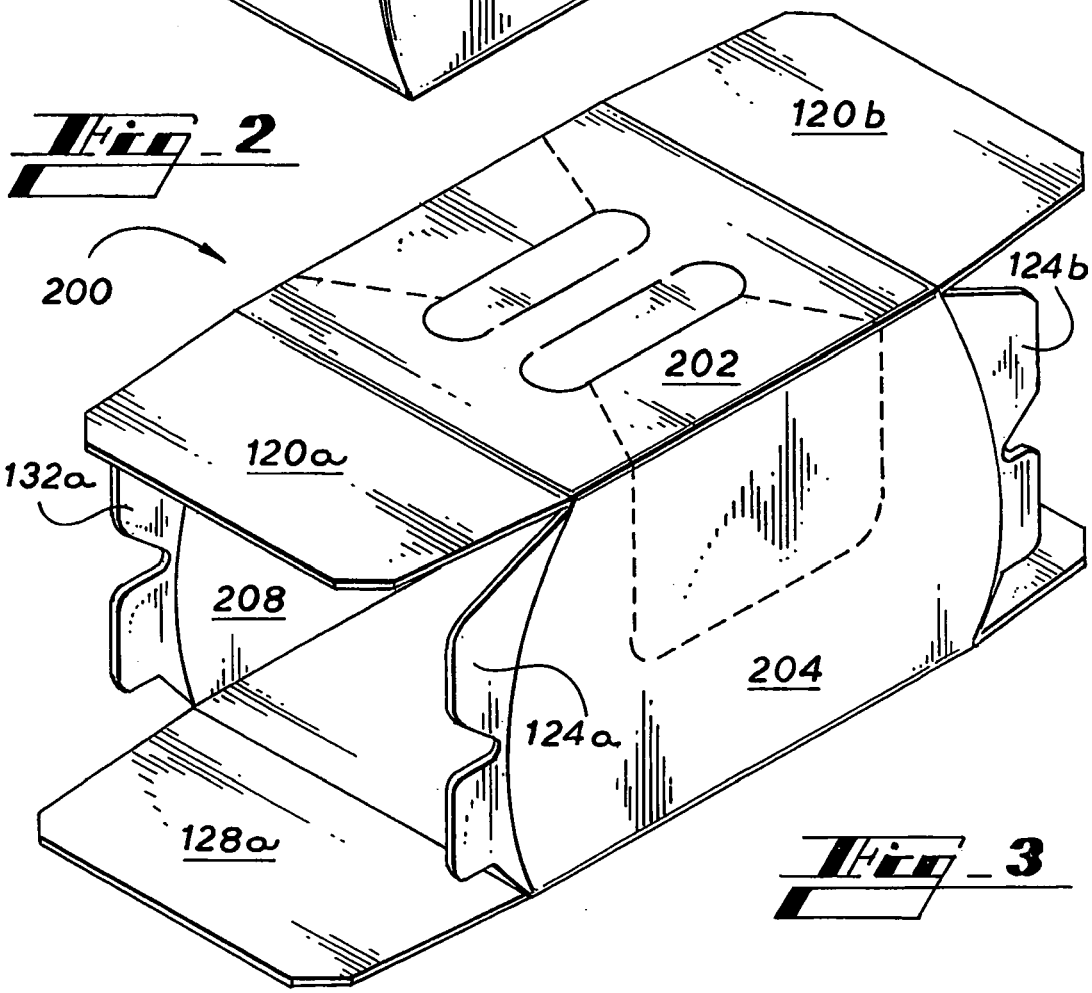
FIG. 3 is a perspective view of the carton of FIG. 2 in an open ended condition.

One method of erecting an open ended tubular carton 200, as shown in FIG. 3, includes folding the blank 100 to connect or otherwise secure the outer surface of the inner top panel 110 to the inside surface of the outer top panel 102, preferably such that the free edge of the inner top panel is immediately adjacent to the top panel fold line 112, and such that the respective severance and fold lines 140, 142 on the outer and inner top panels 102, 110 align to define the handle. More specifically, when the carton 200 is erected, the outer top panel 102 and the inner top panel 110 form a composite top wall 202, the first side panel 104 forms a first side wall 204, the bottom panel 106 forms a bottom wall 206, and the second side panel 108 forms a second side wall 208.

Articles (not shown) may be loaded into the open ends of the tubular carton 200 before folding and securing the end flaps affixed with an "a" reference to form a first end wall 210 and the end flaps affixed with a "b" reference to form a second end wall 212 (shown in FIG. 2). More specifically, the side end flaps 124*a*, 132*a* are folded inwardly along fold lines 126*a*, 134*a*, the bottom end flap 128*a* is folded inwardly along fold line 130*a*, and the top end flap 120*a* is folded inwardly along fold line 122*a*. The flap notches 136*a*, 138*a* facilitate folding the side end flaps 124*a*, 128*a* along the substantially continuously arcuate or otherwise contoured fold lines 126*a*, 134*a* such that the side end flaps 124*a*, 128*a* are allowed to flex as necessary to curve around the base of each end most article. Each flap notch 136*a*, 138*a* preferably extends toward but does not meet the respective fold line 126*a*, 134*a*, thereby enabling the side end flaps 124*a*, 128*a* to provide support for the side wall 204, 208 along fold line 126*a*, 134*a* to prevent bowing, bulging, or other deformation of the side walls 204, 208 when multiple cartons 200 are stacked, while providing flexibility needed to conform to the contours defined by fold lines 126*a*, 134*a*. The end flaps 120*a*, 128*a* at least partially overlap the side end flaps 124*a*, 132*a* and may additionally overlap one another. The top panels 102, 110 and the end flaps 120*a*, 124*a*, 128*a*, 132*a* may be secured by any means for attaching sheet material including, but not limited to, adhesive, mechanical fasteners, VELCRO, or the like.

Figure 4:
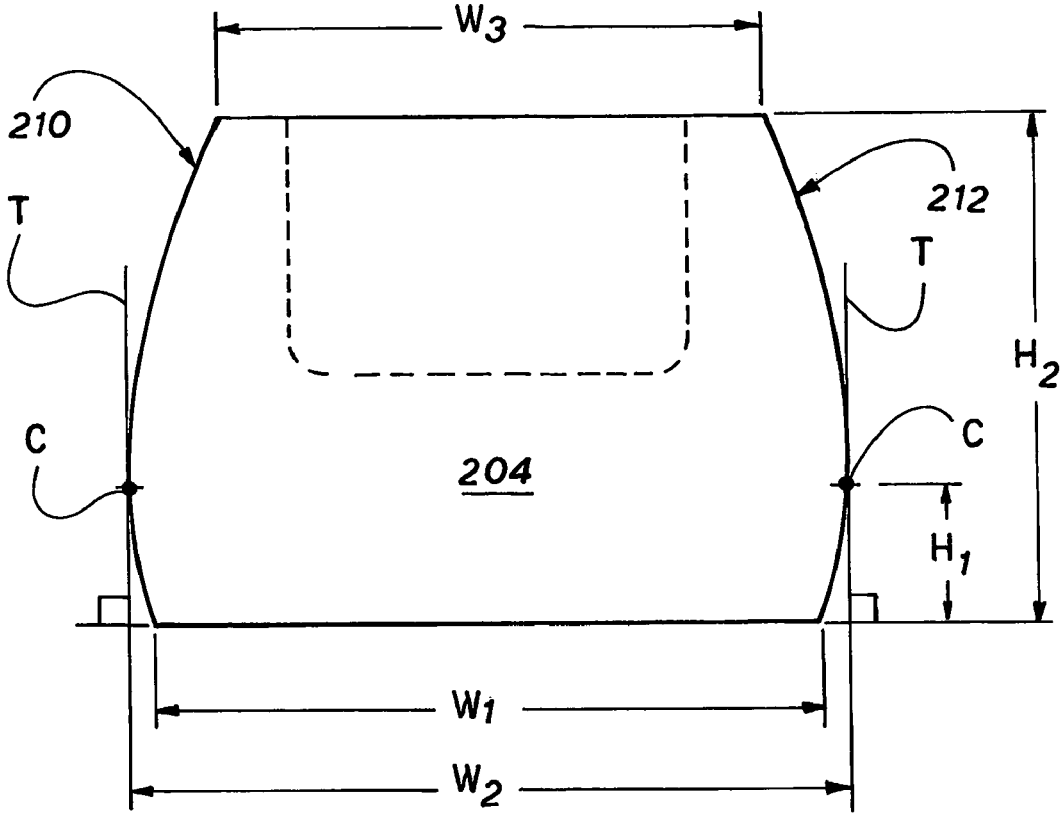
FIG. 4 is a side view of the carton of FIG. 2 showing the shape of the side walls.
Figure 5:
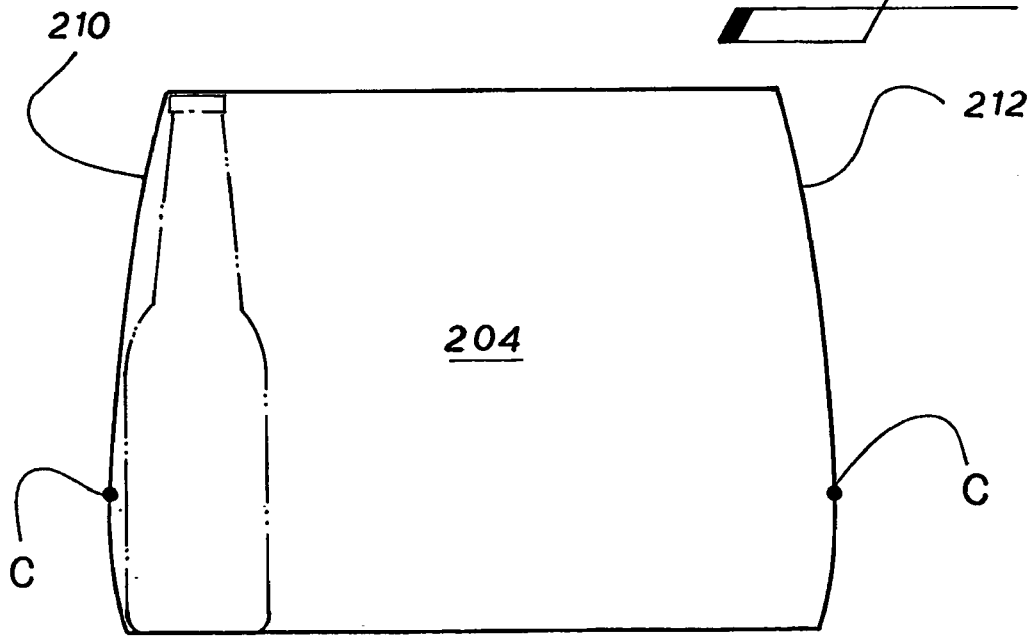
FIG. 5 is a side view of the carton of FIG. 2 showing theshape of the side walls with respect to an exemplary bottle.

In the exemplary embodiment, the side walls 204, 208 are shaped or otherwise contoured to securely enclose articles (not shown) such as bottles in the carton 200. The shape and degree of the curvature of the end edges of the side walls 204, 208 is selected to conform to the contour and shape of the endmost articles that are disposed adjacent to the end wall closures when the carton 200 is fully loaded. This, the curvature of the end edges of the side walls 204, 208, is most useful when each article gradually tapers or otherwise varies in circumference along its length. By conforming to the shape of the article, the carton 200 offers a tighter fit, thereby discouraging tilting of the articles within, which may result in undesirable clinking that can damage the articles or scuff labels affixed thereto. More specifically, as shown in FIG. 4, the width W1 at the bottom edge of the first side wall 204 is less than the maximum width W2 at the widest part of the first side wall 204, as defined as the distance between contact points C where vertical tangent lines T, which are substantially perpendicular to the bottom wall 206, intersect the arcuate end edges of the first side wall 204. The contact points C lie above the horizontal plane defined by the bottom wall 206. More specifically, as shown in FIG. 5, the contact points C lie on the artcuate edges of the first side wall 204 within a vertical range between the bottom wall 206 and the shoulder height of an article. For example, in the exemplary embodiment, the contact points C that define the maximum width W2 of the first side wall 204 are located at a vertical distance H1 from the bottom wall 206 where the vertical distance H1 is approximately one-third of the vertical height H2 of the carton 200. The width W3 at the top edge of the side wall 204 is less than the width W1 at the bottom edge of the side wall 204 and the width W1 at the bottom edge of the side wall 204 is less than the maximum width W2. Thus, the exemplary carton 200 is suitable for enclosing long-necked bottles that taper inward from a maximum circumference at about one-third of the height of the bottle and has a tightening effect on the bottles contained therein to provide additional support to the bottom portion of the bottles. Other embodiments are contemplated to provide a tighter enclosure for the alternatively shaped bottles where the maximum width W2 is disposed, for example, at about one half the vertical height H2. Accordingly, articles that taper equally at both ends and flare in the middle can be accommodated by setting W1=W3 and W2>(W1 or W3). Numerous other article shapes can be accommodated by varying the position of H1 and the relative lengths of W1, W2, and W3. The most common beverage bottles currently distributed dictate H1 being disposed at or below approximately one half the carton height H2.

It must be emphasized that the above-described embodiments are merely exemplary illustrations of implementations set forth for a clear understanding of the principles of the invention. Many variations and modifications may be made to the above-described embodiments without departing from the scope of the claims. All such modifications, combinations, and variation are included herein by the scope of this disclosure and the following claims.

What is claimed is:

1. A carton, comprising:

a tubular structure defined by a plurality of walls, said plurality of walls comprising:

a pair of opposed substantially planar side walls, each side wall comprising:

a top edge;

a bottom edge; and a pair of opposing end edges, each end edge being substantially continuously arcuate such that said end edges are curved convexly away from each other and such that said each side wall has a maximum width that is greater than the extent of said bottom edge; and an end closure structure that encloses an end of said tubular structure, said end closure structure comprising a pair of side end flaps, each side end flap being hingedly connected to a respective one of said side walls along one of said end edges of said respective side wall.

2. The carton of claim 1, wherein:

said plurality of walls further comprises a top wall hingedly connected to said side walls along said top edges, and a bottom wall hingedly connected to said side walls along said bottom edges;

said carton has a height that is defined by the distance between said top wall and said bottom wall; and the distance between said bottom wall and a point along said each end edge at which said each side wall achieves its maximum width is no more than a half of said carton height.

3. The carton of claim 1, wherein each of said side end flaps comprises a notch to facilitate folding said each side end flap along said one of said end edges of said respective side wall.

4. The carton of claim 1, wherein said end closure structure is continuously curved convexly outwardly.

5. The carton of claim 2, wherein:

said distance between said bottom wall and said point along said each end edge at which said each side wall achieves its maximum width is less than a half of said carton height.

6. The carton of claim 3, wherein each said notch extends from an edge of a respective one of said side end flaps toward an adjacent one of said end edges.

7. The carton of claim 1, wherein one of said side walls is hingedly connected along its top edge to an inner top panel and the other of said side walls is hingedly connected along its top edge to an outer top panel, and said inner top panel is secured in a face contacting arrangement to said outer top panel to form a composite top wall.

8. The carton of claim 1, wherein said bottom edge is longer than said top edge.

9. A blank for forming a carton, the blank comprising:

a plurality of panels hingedly connected one to the next that can be arranged to form a tubular structure, the plurality of panels comprising:

a first side panel and a second side panel each comprising:

a pair of end edges, a top edge and a bottom edge, said top edge and said bottom edge each extending between said pair of end edges; each end edge being substantially continuously arcuate such that said end edges are curved convexly away from each other and such that each said side panel has a maximum width that is greater than the extent of said bottom edge; and a pair of side end flaps for defining an end closure of said tubular structure, each said side end flap being hingedly connected to a respective one of said side panels along one of said end edges of said respective side panel.

10. The blank of claim 9, wherein said plurality of panels are hingedly connected one to the next and disposed along a longitudinal axis, and at least one of said side panels is hingedly connected to at least one of said plurality of panels along a transverse fold line that defines one of said top edge and said bottom edge.

11. The blank of claim 9, wherein:

said plurality of panels further comprises:

an inner top panel hingedly connected along said top edge of said first side panel; and an outer top panel hingedly connected along said top edge of said second side panel;

wherein said inner top panel and said outer top panel are foldable into an at least partially overlapping face contacting arrangement to form said tubular structure.

12. A package, comprising:

a carton, comprising:

a tubular structure defined by a plurality of walls, said plurality of walls comprising:

a pair of substantially planar opposed side walls, each side wall comprising:

a top edge;

a bottom edge; and a pair of opposing end edges, each end edge being substantially continuously arcuate such that said end edges are curved convexly away from each other and such that said each side wall has a maximum width that is greater than the extent of said bottom edge; and an end closure structure that encloses an end of said tubular structure, said end closure structure comprising a pair of side end flaps, each end flap being hingedly connected to a respective one of said side walls along one of said end edges of said respective side wall; and a plurality of articles enclosed within said carton, said articles being disposed on ends thereof, each article being substantially cylindrical, each article having a first cross-sectional area that tapers to a cross-sectional area that is less than said first cross-sectional area;

wherein each of said one of said end edges has a degree of curvature that approximates the shape of each of said plurality of articles.

13. The package of claim 12, wherein said plurality of articles is arranged in rows aligned with said end closure structure, wherein an endmost row of articles is adjacent to said end closure structure such that said endmost articles are tightly engaged by said adjacent end closure structure.

14. The package of claim 13, wherein said one of said end edges of each of said side walls curves inwardly toward lower ends of said endmost articles.

15. The package of claim 13, wherein said one of said end edges of each of said side walls has a degree of curvature that approximates the shape of each of said plurality of articles such that said end closure structure contacts each of said end most articles at no less than two points of contact.

16. The package of claim 15, wherein said no less than two points of contact includes points of contact at upper and lower ends of each of said endmost articles.

17. The package of claim 16, wherein said no less than two points further includes at least one point between said upper and lower ends of each of said endmost articles.

18. The package of claim 12, wherein each said article tapers downward from said first cross sectional area to a lower portion having said second cross-sectional area.

19. The package of claim 12, wherein each said article tapers upward from said first cross sectional area to an upper portion having said second cross-sectional area.

* * * * *